US010457299B2

(12) United States Patent
Angel et al.

(10) Patent No.: US 10,457,299 B2
(45) Date of Patent: Oct. 29, 2019

(54) TRAIN STOP TIMER

(71) Applicant: Westinghouse Air Brake Technologies Corporation, Wilmerding, PA (US)

(72) Inventors: Kevin J. Angel, Marion, IA (US); Ann K. Grimm, Cedar Rapids, IA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 209 days.

(21) Appl. No.: 15/439,119

(22) Filed: Feb. 22, 2017

(65) Prior Publication Data

US 2018/0237042 A1 Aug. 23, 2018

(51) Int. Cl.

| | |
|---|---|
| ***B61K 9/12*** | (2006.01) |
| ***B61L 25/02*** | (2006.01) |
| ***B61L 15/00*** | (2006.01) |
| ***B61L 27/00*** | (2006.01) |

(52) U.S. Cl.

CPC ..... *B61K 9/12* (2013.01); *B61L 15/0027* (2013.01); *B61L 25/021* (2013.01); *B61L 25/025* (2013.01); *B61L 27/0077* (2013.01); *B61L 27/0011* (2013.01); *B61L 2205/04* (2013.01)

(58) Field of Classification Search

CPC ... B61K 9/00; B61K 9/02; B61K 9/08; B61K 9/12; B61L 25/00; B61L 25/02; B61L 25/021; B61L 25/025

See application file for complete search history.

(56) References Cited

U.S. PATENT DOCUMENTS

| | | | | |
|---|---|---|---|---|
| 6,671,591 | B2 | 12/2003 | Wolf et al. | |
| 6,873,888 | B2 * | 3/2005 | Kumar | B60L 9/00 701/19 |
| 9,098,995 | B2 | 8/2015 | Marafioti et al. | |
| 9,340,220 | B2 | 5/2016 | Fries et al. | |
| 2002/0103585 | A1 | 8/2002 | Biess et al. | |
| 2005/0205719 | A1 * | 9/2005 | Hendrickson | B61L 15/0027 246/122 R |
| 2012/0001029 | A1 | 1/2012 | Kondo et al. | |

FOREIGN PATENT DOCUMENTS

| | | | |
|---|---|---|---|
| JP | 2012192860 | A | 10/2012 |
| KR | 101037175 | B1 | 5/2011 |
| KR | 20150080100 | A | 7/2015 |
| WO | 2014095029 | A1 | 6/2014 |

* cited by examiner

*Primary Examiner* — Robert J McCarry, Jr.
(74) *Attorney, Agent, or Firm* — The Webb Law Firm

(57) ABSTRACT

A train control system and method for a train including at least one locomotive or control car and, optionally, at least one railroad car, in a track network having a plurality of tracks, includes at least one computer programmed or configured to receive or determine an indication that the train is stopped, continuously increment a counter in response to the indication that the train is stopped, and control an operator interface to output a current count of the counter to an operator of the train.

26 Claims, 10 Drawing Sheets

TRAIN STOP TIMER

BACKGROUND OF THE INVENTION

Field of the Invention

This invention relates generally to vehicle systems and control processes, such as railway systems including trains travelling in a track or rail network, and in particular to a system and method for determining and/or providing onboard a locomotive or a control car an amount of time that a train is stopped that may be used in connection with positive train control (PTC) systems.

Description of Related Art

Vehicle systems and networks exist throughout the world, and, at any point in time, a multitude of vehicles, such as cars, trucks, buses, trains, and the like, are travelling throughout the system and network. With specific reference to trains travelling in a track network, the locomotives of such trains are typically equipped with or operated using train control, communication, and management systems (e.g., positive train control (PTC) systems), such as the I-ETMS® of Wabtec Corp. In order to effectively manage all of the trains, navigation and enforcement systems and processes are implemented, both at the train level and the central dispatch level.

Existing sources of time on-board a locomotive or control car of a train do not take advantage of interfaces to a locomotive wheel tachometer or a track database to put time into context in a useful manner for an operator or crew of the train. For example, as shown in FIG. 1A, the I-ETMS® of Wabtec Corp. includes a current local time displayed in the upper left-hand corner of the on-board segment display. This clock is displayed when the on-board segment has a known track location so that the on-board segment can look up a local time zone from track data and display the current local time for the time zone in which the train is located. However, in order for the operator of the train to use the clock to determine how long the train has been stopped, e.g., at a station stop for a passenger or commuter train, the operator must remember to make note of the time when the train first comes to a stop, make note of the time when the train starts to move again, and mentally perform a calculation of the difference therebetween to determine how long the train is stopped, which introduces the possibility for operator error and requires additional effort on the part of the operator or crew.

Furthermore, there are other scenarios where it is useful to the operator or crew of the train to know how long the train has been stopped. For example, the General Code of Operating Rules (GCOR) Rule 6.32.6 Blocking Public Crossings states that crews should avoid blocking a public crossing for longer than 10 minutes. Accordingly, it is useful to the operator or crew of the train to know how long the train has been stopped with respect to a particular location or track feature, such as a crossing. Moreover, it is useful to the operator or crew of the train to know how long the train has been stopped for reporting delays back to a dispatcher, e.g., with respect to freight trains.

For at least these reasons, there is a need in the art for an improved system and method for determining and/or providing onboard a locomotive or control car an amount of time that a train is stopped.

SUMMARY OF THE INVENTION

Generally, provided are an improved system and computer-implemented method for determining and/or providing onboard a locomotive an amount of time that a train is stopped, preferably for use in connection with trains located in a track network. Preferably, provided are a system and computer-implemented method that can be used to enhance existing train control systems. Preferably, provided are a system and computer-implemented method that take advantage of an interface to a locomotive wheel tachometer and/or a track database to put time into context in a useful manner for an operator or crew of a train. Preferably, provided are a system and computer-implemented method that provide railroad operators or crews information indicating how long a train has been stopped, for example, for passenger and commuter trains to time station stops and for freight customers to accurately track and report train delays. Preferably, provided are a system and computer-implemented method that use an accurate source of locomotive speed, such as an output from an active wheel tachometer, to determine and/or provide onboard a locomotive an amount of time that a train is stopped.

According to one preferred and non-limiting embodiment or aspect, provided is a train control system for a train including at least one locomotive or control car and, optionally, at least one railroad car, in a track network having a plurality of tracks, the system comprising: an operator interface on-board the at least one locomotive or control car configured to provide information to an operator of the train; and at least one computer programmed or configured to: receive or determine an indication that the train is stopped; continuously increment a counter in response to the indication that the train is stopped; and control the operator interface to output a current count of the counter to the operator of the train.

In one preferred and non-limiting embodiment or aspect, the at least one computer is programmed or configured to: receive or determine an indication that the train is moving; and stop incrementing the counter in response to the indication that the train is moving.

In one preferred and non-limiting embodiment or aspect, the system further comprises an active wheel tachometer configured to provide the indication that the train is stopped to the at least one computer.

In one preferred and non-limiting embodiment or aspect, the operator interface comprises a visual display device configured to display the current count of the counter to the operator of the train.

In one preferred and non-limiting embodiment or aspect, the operator interface comprises an audio output device configured to output an audible signal based at least partly on the current count of the counter.

In one preferred and non-limiting embodiment or aspect, the at least one computer is programmed or configured to: compare the current count of the counter to a threshold count; and control the operator interface to output an alert if the current count of the counter violates the threshold count.

In one preferred and non-limiting embodiment or aspect, the at least one computer is programmed or configured to: receive or determine at least one location associated with the train, the at least one locomotive or control car of the train, the at least one railroad car, or any combination thereof; compare the current count of the counter to a threshold count associated with the at least one location; and control the operator interface to output an alert if the current count of the counter violates the threshold count associated with the at least one location.

In one preferred and non-limiting embodiment or aspect, the at least one computer is programmed or configured to: determine that the at least one location corresponds to a location of a track data feature, wherein the location of the track data feature is associated with the threshold count.

In one preferred and non-limiting embodiment or aspect, the system further comprises at least one of a GPS and an inertial sensor system, wherein the at least one computer is programmed or configured to: determine the at least one location associated with the train, the at least one locomotive or control car of the train, the at least one railroad car, or any combination thereof based on data received from at least one of the GPS, the inertial sensor system, or any combination thereof.

In one preferred and non-limiting embodiment or aspect, the at least one computer is programmed or configured to: control the operator interface to continuously output a count at which the counter is stopped incrementing when the train is moving.

In one preferred and non-limiting embodiment or aspect, the at least one computer is programmed or configured to: reset the current count of the counter in response to the indication that the train is stopped before continuously incrementing the counter.

In one preferred and non-limiting embodiment or aspect, the system further comprises at least one of a wheel tachometer, a GPS, an inertial sensor system, a GLONASS system, a Wi-Fi positioning system, or any combination thereof, wherein the at least one computer is programmed or configured to: determine the indication that the train is stopped based on output data from at least one of the wheel tachometer, the GPS, the inertial sensor system, the GLONASS system, the Wi-Fi positioning system or any combination thereof.

According to one preferred and non-limiting embodiment or aspect, provided is a computer implemented train control method for a train including at least one locomotive or control car and, optionally, at least one railroad car, in a track network having a plurality of tracks, the method comprising: receiving or determining an indication that the train is stopped; continuously incrementing a counter in response to the indication that the train is stopped; and controlling the operator interface to output a current count of the counter to the operator of the train.

In one preferred and non-limiting embodiment or aspect, the method further comprises receiving or determining an indication that the train is moving; and stopping incrementing of the counter in response to the indication that the train is moving.

In one preferred and non-limiting embodiment or aspect, an output of an active wheel tachometer is received or determined as the indication that the train is stopped.

In one preferred and non-limiting embodiment or aspect, the operator interface comprises a visual display device, the method further comprising controlling the visual display device to display the current count of the counter to the operator of the train.

In one preferred and non-limiting embodiment or aspect, the operator interface comprises an audio output device, the method further comprising controlling the audio output device to output an audible signal based at least partly on the current count of the counter.

In one preferred and non-limiting embodiment or aspect, the method further comprises comparing the current count of the counter to a threshold count; and controlling the operator interface to output an alert if the current count of the counter violates the threshold count.

In one preferred and non-limiting embodiment or aspect, the method further comprises receiving or determining at least one location associated with the train, the at least one locomotive or control car of the train, the at least one railroad car, or any combination thereof; comparing the current count of the counter to a threshold count associated with the at least one location; and controlling the operator interface to output an alert if the current count of the counter violates the threshold count associated with the at least one location.

In one preferred and non-limiting embodiment or aspect, the method further comprises determining that the at least one location corresponds to a location of a track data feature, wherein the location of the track data feature is associated with the threshold count.

In one preferred and non-limiting embodiment or aspect, the method further comprises determining the at least one location associated with the train, the at least one locomotive or control car of the train, the at least one railroad car, or any combination thereof based on output data received from at least one of a GPS, an inertial sensor system, or any combination thereof.

In one preferred and non-limiting embodiment or aspect, the method further comprises controlling the operator interface to continuously output a count at which the counter is stopped incrementing when the train is moving.

In one preferred and non-limiting embodiment or aspect, the method further comprises resetting the current count of the counter in response to the indication that the train is stopped before continuously incrementing the counter.

In one preferred and non-limiting embodiment or aspect, the method further comprises determining the indication that the train is stopped based on output data from at least one of a wheel tachometer, a GPS, an inertial sensor system, a GLONASS system, a Wi-Fi positioning system, or any combination thereof.

Other preferred and non-limiting embodiments or aspects of the present invention will be set forth in the following numbered clauses:

Clause 1. A train control system for a train including at least one locomotive or control car and, optionally, at least one railroad car, in a track network having a plurality of tracks, the system comprising: an operator interface on-board the at least one locomotive or control car configured to provide information to an operator of the train; and at least one computer programmed or configured to: receive or determine an indication that the train is stopped; continuously increment a counter in response to the indication that the train is stopped; and control the operator interface to output a current count of the counter to the operator of the train.

Clause 2. The train control system of clause 1, wherein the at least one computer is programmed or configured to: receive or determine an indication that the train is moving; and stop incrementing the counter in response to the indication that the train is moving.

Clause 3. The train control system of clause 1 or 2, further comprising an active wheel tachometer configured to provide the indication that the train is stopped to the at least one computer.

Clause 4. The train control system of any of clauses 1-3, wherein the operator interface comprises a visual display device configured to display the current count of the counter to the operator of the train.

Clause 5. The train control system of any of clauses 1-4, wherein the operator interface comprises an audio output device configured to output an audible signal based at least partly on the current count of the counter.

Clause 6. The train control system of any of clauses 1-5, wherein the at least one computer is programmed or configured to: compare the current count of the counter to a threshold count; and control the operator interface to output an alert if the current count of the counter violates the threshold count.

Clause 7. The train control system of any of clauses 1-6, wherein the at least one computer is programmed or configured to: receive or determine at least one location associated with the train, the at least one locomotive or control car of the train, the at least one railroad car, or any combination thereof; compare the current count of the counter to a threshold count associated with the at least one location; and control the operator interface to output an alert if the current count of the counter violates the threshold count associated with the at least one location.

Clause 8. The train control system of any of clauses 1-7, wherein the at least one computer is programmed or configured to: determine that the at least one location corresponds to a location of a track data feature, wherein the location of the track data feature is associated with the threshold count.

Clause 9. The train control system of any of clauses 1-8, further comprising at least one of a GPS and an inertial sensor system, wherein the at least one computer is programmed or configured to: detetinine the at least one location associated with the train, the at least one locomotive or control car of the train, the at least one railroad car, or any combination thereof based on data received from at least one of the GPS, the inertial sensor system, or any combination thereof.

Clause 10. The train control system of any of clauses 1-9, wherein the at least one computer is programmed or configured to: control the operator interface to continuously output a count at which the counter is stopped incrementing when the train is moving.

Clause 11. The train control system of any of clause 1-10, wherein the at least one computer is programmed or configured to: reset the current count of the counter in response to the indication that the train is stopped before continuously incrementing the counter.

Clause 12. The train control system of any of clauses 1-11, further comprising at least one of a wheel tachometer, a GPS, an inertial sensor system, a GLONASS system, a Wi-Fi positioning system, or any combination thereof, wherein the at least one computer is programmed or configured to: determine the indication that the train is stopped based on output data from at least one of the wheel tachometer, the GPS, the inertial sensor system, the GLONASS system, the Wi-Fi positioning system or any combination thereof.

Clause 13. A computer implemented train control method for a train including at least one locomotive or control car and, optionally, at least one railroad car, in a track network having a plurality of tracks, the method comprising: receiving or determining an indication that the train is stopped; continuously incrementing a counter in response to the indication that the train is stopped; and controlling the operator interface to output a current count of the counter to the operator of the train.

Clause 14. The train control method of clause 13, further comprising: receiving or determining an indication that the train is moving; and stopping incrementing of the counter in response to the indication that the train is moving.

Clause 15. The train control method of clause 13 or 14, wherein an output of an active wheel tachometer is received or determined as the indication that the train is stopped.

Clause 16. The train control method of any of clauses 13-15, wherein the operator interface comprises a visual display device, the method further comprising controlling the visual display device to display the current count of the counter to the operator of the train.

Clause 17. The train control method of any of clauses 13-16, wherein the operator interface comprises an audio output device, the method further comprising controlling the audio output device to output an audible signal based at least partly on the current count of the counter.

Clause 18. The train control method of any of clauses 13-17, further comprising: comparing the current count of the counter to a threshold count; and controlling the operator interface to output an alert if the current count of the counter violates the threshold count.

Clause 19. The train control method of any of clauses 13-18, further comprising: receiving or determining at least one location associated with the train, the at least one locomotive or control car of the train, the at least one railroad car, or any combination thereof; comparing the current count of the counter to a threshold count associated with the at least one location; and controlling the operator interface to output an alert if the current count of the counter violates the threshold count associated with the at least one location.

Clause 20. The train control method of any of clauses 13-19, further comprising determining that the at least one location corresponds to a location of a track data feature, wherein the location of the track data feature is associated with the threshold count.

Clause 21. The train control method of any of clauses 13-20, further comprising: determining the at least one location associated with the train, the at least one locomotive or control car of the train, the at least one railroad car, or any combination thereof based on output data received from at least one of a GPS, an inertial sensor system, or any combination thereof.

Clause 22. The train control method of any of clauses 13-21, further comprising controlling the operator interface to continuously output a count at which the counter is stopped incrementing when the train is moving.

Clause 23. The train control method of any of clauses 13-22, further comprising resetting the current count of the counter in response to the indication that the train is stopped before continuously incrementing the counter.

Clause 24. The train control method of any of clauses 13-23, further comprising: determining the indication that the train is stopped based on output data from at least one of a wheel tachometer, a GPS, an inertial sensor system, a GLONASS system, a Wi-Fi positioning system, or any combination thereof.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1A:
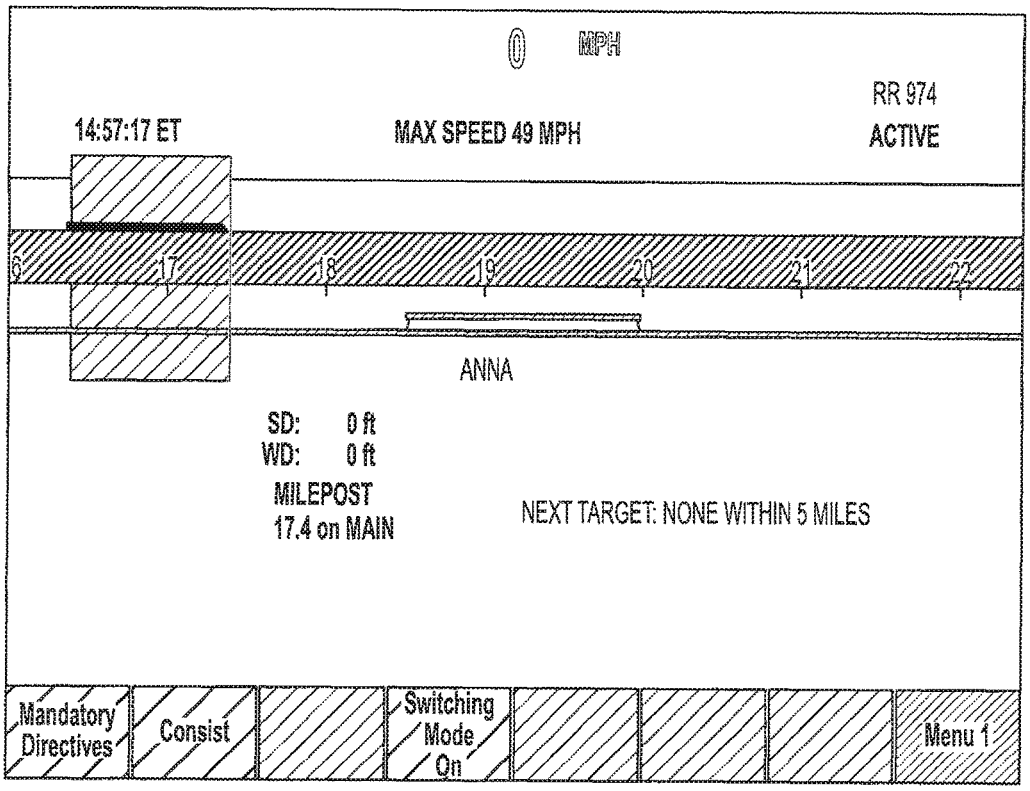
FIG. 1A (PRIOR ART)
FIG. 1A illustrates an example operator interface of a train control system according to the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the teens "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. It is to be noted that a "communication device" includes any device that facilitates communication (whether wirelessly or hard-wired (e.g., over the rails of a track, over a trainline extending between railcars of a train, and the like)) between two units, such as two locomotive units or control cars. In one preferred and non-limiting embodiment or aspect, the "communication device" is a radio transceiver programmed, configured, or adapted to wirelessly transmit and receive radio frequency signals and data over a radio signal communication path.

The system and computer-implemented method for determining and/or providing onboard a locomotive an amount of time that a train is stopped described herein may be implemented in a variety of systems and vehicular networks; however, the systems and methods described herein are particularly useful in connection with a railway system and network. Accordingly, the presently-invented methods and systems can be implemented in various known train control and management systems, e.g., the I-ETMS® of Wabtec Corp. The systems and methods described herein are useful in connection with and/or at least partially implemented on one or more locomotives or control cars (L) that make up a train (TR). It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight train, and/or other train arrangements and systems. Still further, the train (TR) may be separated into different configurations (e.g., other trains (TR)) and moved in either a first direction and/or a second direction. Any configuration or arrangement of locomotives, control cars, and/or railroad cars may be designated as a train and/or a consist.

In one preferred and non-limiting embodiment or aspect, the methods and systems described herein are used in connection with the locomotives or controls cars (L) that are positioned on each end of the train (TR), while in other preferred and non-limiting embodiments or aspects, the methods and systems described herein are used in connection with locomotives or control cars (L) that are positioned intermediately in the train (TR) (since these intermediate locomotives or control cars (L) may eventually become a controlling locomotive or control car (L) when the train (TR) is reconfigured). It is also noted that the methods and systems described herein may be used in connection with "electrical multiple unit" (EMU) or "diesel multiple unit" (DMU) configurations, where a locomotive does not technically exist, but multiple control cars would still be present. Still further, the train (TR) may include only one locomotive or control car (L) and/or some or no railroad cars. It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight trains, push-pull train configurations, and/or other train arrangements and systems. Still further, the train (TR) may be separated into different configurations (e.g., other trains (TR)) and moved in either a first direction and/or a second direction. Any configuration or arrangement of locomotives, control cars, and/or railroad cars may be designated as a train and/or a consist. Still further, it is to be expressly understood that the presently-invented methods and systems described herein may be implemented on and/or used in connection with an auxiliary vehicle, such as an auxiliary railroad vehicle, a maintenance vehicle or machine, a road vehicle (e.g., truck, pick-up truck, car, or other machine), a vehicle equipped to ride on the rails of the track, and/or the like.

Figure 1B:
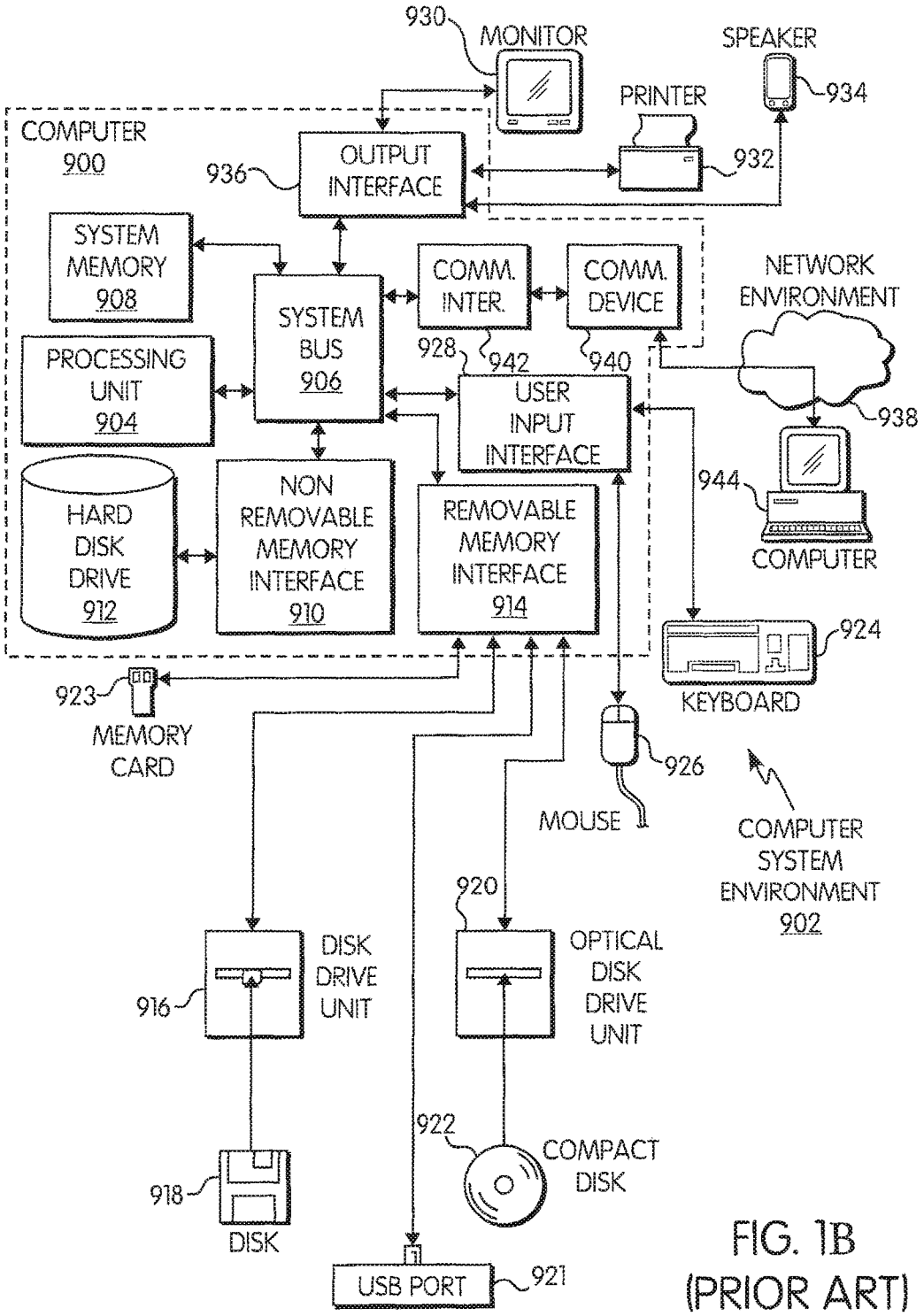
FIG. 1B (PRIOR ART)
FIG. 1B is a schematic view of a computer system and environment according to the prior art.

As shown in FIG. 1B, and according to the prior art, personal computers 900, 944, in a computing system environment 902 may be provided or utilized, such as in connection with the on-board computer described below. This computing system environment 902 may include, but is not limited to, at least one computer 900 having certain components for appropriate operation, execution of code, and creation and communication of data. For example, the computer 900 includes a processing unit 904 (typically referred to as a central processing unit or CPU) that serves to execute computer-based instructions received in the appropriate data form and format. Further, this processing unit 904 may be in the form of multiple processors executing code in series, in parallel, or in any other manner for appropriate implementation of the computer-based instructions.

In order to facilitate appropriate data communication and processing information between the various components of the computer 900, a system bus 906 is utilized. The system bus 906 may be any of several types of bus structures, including a memory bus or memory controller, a peripheral bus, or a local bus using any of a variety of bus architectures. In particular, the system bus 906 facilitates data and information communication between the various components (whether internal or external to the computer 900) through a variety of interfaces, as discussed hereinafter.

The computer 900 may include a variety of discrete computer-readable media components. For example, this computer-readable media may include any media that can be accessed by the computer 900, such as volatile media, non-volatile media, removable media, non-removable media, etc. As a further example, this computer-readable media may include computer storage media, such as media implemented in any method or technology for storage of information, such as computer-readable instructions, data structures, program modules, or other data, random access memory (RAM), read only memory (ROM), electrically erasable programmable read only memory (EEPROM), flash memory, or other memory technology, CD-ROM, digital versatile disks (DVDs), or other optical disk storage, magnetic cassettes, magnetic tape, magnetic disk storage, or other magnetic storage devices, or any other medium which can be used to store the desired information and which can be accessed by the computer 900. Further, this computer-readable media may include communications media, such as computer-readable instructions, data structures, program modules, or other data in other transport mechanisms and include any information delivery media, wired media (such as a wired network and a direct-wired connection), and wireless media. Computer-readable media may include all machine-readable media with the sole exception of transitory, propagating signals. Of course, combinations of any of the above should also be included within the scope of computer-readable media.

As seen in FIG. 1B, the computer 900 further includes a system memory 908 with computer storage media in the form of volatile and non-volatile memory, such as ROM and RAM. A basic input/output system (BIOS) with appropriate computer-based routines assists in transferring information between components within the computer 900 and is normally stored in ROM. The RAM portion of the system memory 908 typically contains data and program modules that are immediately accessible to or presently being operated on by processing unit 904, e.g., an operating system, application programming interfaces, application programs, program modules, program data and other instruction-based computer-readable codes.

With continued reference to FIG. 1B, the computer 900 may also include other removable or non-removable, volatile or non-volatile computer storage media products. For example, the computer 900 may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD ROM), a Universal Serial Bus (USB) port 921 for use in connection with a removable memory card 923, etc. However, it is envisioned that other removable or non-removable, volatile or non-volatile computer storage media can be used in the exemplary computing system environment 902, including, but not limited to, magnetic tape cassettes, DVDs, digital video tape, solid state RAM, solid state ROM, etc. These various removable or non-removable, volatile or non-volatile magnetic media are in communication with the processing unit 904 and other components of the computer 900 via the system bus 906. The drives and their associated computer storage media discussed above and illustrated in FIG. 1B provide storage of operating systems, computer-readable instructions, application programs, data structures, program modules, program data and other instruction-based computer-readable code for the computer 900 (whether duplicative or not of this information and data in the system memory 908).

A user may enter commands, information, and data into the computer 900 through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including any arrangement that facilitates the input of data, and information to the computer 900 from an outside source. As discussed, these and other input devices are often connected to the processing unit 904 through the user input interface 928 coupled to the system bus 906, but may be connected by other interface and bus structures, such as a parallel port, game port, or a universal serial bus (USB) 921. Still further, data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the computer 900 through an output interface 936 coupled to the system bus 906. It is envisioned that any such peripheral output devices be used to provide information and data to the user.

The computer 900 may operate in a network environment 938 through the use of a communications device 940, which is integral to the computer or remote therefrom. This communications device 940 is operable by and in communication to the other components of the computer 900 through a communications interface 942. Using such an arrangement, the computer 900 may connect with or otherwise communicate with one or more remote computers, such as a remote computer 944, which may be a personal computer, a server, a router, a network personal computer, a peer device, or other common network nodes, and typically includes many or all of the components described above in connection with the computer 900. Using appropriate communication devices 940, e.g., a modem, a network interface or adapter, etc., the computer 900 may operate within and communicate through a local area network (LAN) and a wide area network (WAN), but may also include other networks such as a virtual private network (VPN), an office network, an enterprise network, an intranet, the Internet, etc. It will be appreciated that the network connections shown are exemplary and other means of establishing a communications link between the computers 900, 944 may be used.

As used herein, the computer 900 includes or is operable to execute appropriate custom-designed or conventional software to perform and implement the processing steps of the method and system of the present invention, thereby, forming a specialized and particular computing system. Accordingly, the presently-invented method and system may include one or more computers 900 or similar computing devices having a computer-readable storage medium capable of storing computer-readable program code or instructions that cause the processing unit 904 to execute, configure or otherwise implement the methods, processes, and transformational data manipulations discussed hereinafter in connection with the present invention. Still further, the computer 900 may be in the form of any type of computing device having the necessary processing hardware to appropriately process data to effectively implement the presently-invented computer-implemented method and system.

As discussed hereinafter, the system and method for determining and/or providing onboard a locomotive an amount of time that a train is stopped of the present invention may be implemented by, programmed or configured on, or otherwise associated with any type of computer or processor, such as one or more of the following: a specially-programmed computer, an on-board controller, an on-board computer 10 (as discussed hereinafter), a train management computer, a remote server, a back office server 23, a wayside device, a PTC component, a networked computer, or any combination thereof. Accordingly, some or all of the steps in the system, process, and method discussed hereinafter may be implemented and/or executed on-board a locomotive or control car (L), and similarly, some or all of the steps in the system, process, and method discussed hereinafter may be implemented and/or executed by a computer or processor that is remote from the train (TR), where the remote computer or processor is in direct or indirect communication with a communication device 12 of the train (TR).

Figure 2A:
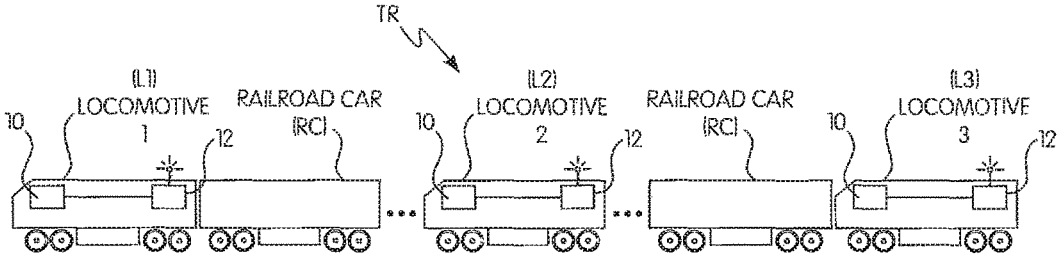
FIG. 2A is a schematic view of a system for determining and/or providing onboard a locomotive an amount of time that a train is stopped according to the principles of the present invention.
Figure 2B:
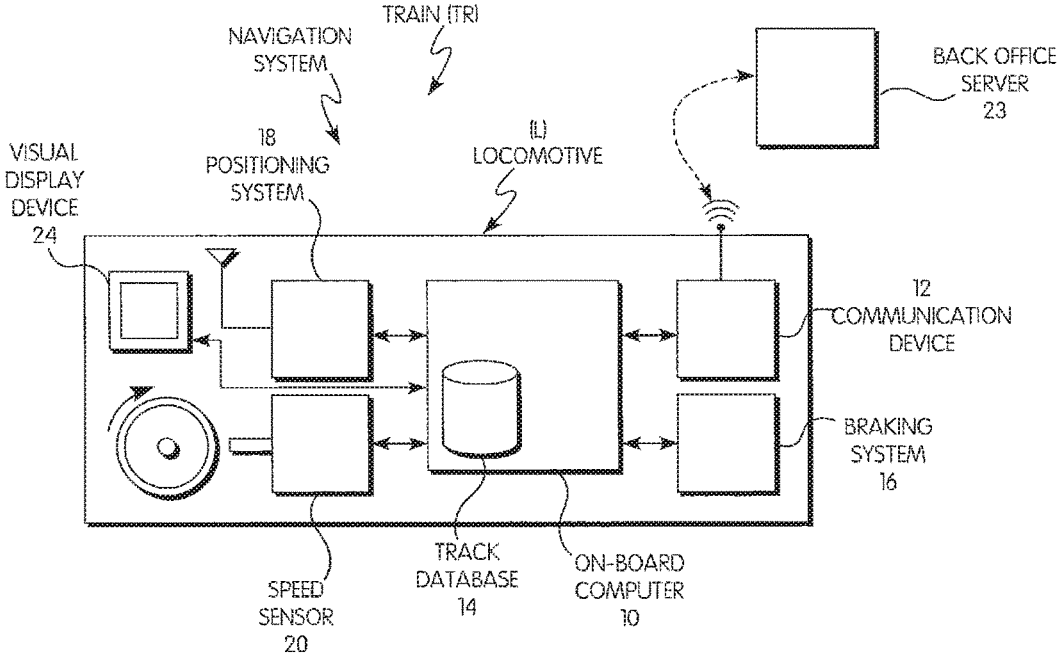
FIG. 2B is a schematic view of one embodiment of determining and/or providing onboard a locomotive an amount of time that a train is stopped according to the principles of the present invention.

With specific reference to FIGS. 2A and 2B, and in one preferred and non-limiting embodiment or aspect, provided is a system for determining and/or providing onboard a locomotive an amount of time that a train is stopped for a train (TR) including at least one locomotive or control car (L) and, optionally, one or more railcars (RC). For example, in one implementation, the train (TR) may include a plurality of locomotives (L1, L2, L3) and a plurality of rail cars (RC). In another implementation, the train (TR) may include only a single locomotive (L) and no rail cars (RC). The locomotive(s) (L) are equipped with at least an on-board computer 10 (e.g., an on-board controller, a train management computer, an on-board processor, and/or the like) programmed or configured to implement or facilitate at least one train action and a communication device 12 in communication with the on-board computer 10 and programmed or configured to receive, transmit, and/or process data signals. While the communication device 12 may be in the form of a wireless communication device (as illustrated in FIG. 2B), as discussed herein, this communication device 12 may also be programmed or configured to transmit, process, and/or receive signals over a trainline, using an ECP component, over the rails, and/or the like.

The system architecture used to support the functionality of at least some of the methods and systems described herein includes: the train management computer or on-board computer 10 (which performs calculations for or within the Positive Train Control (PTC) system, including navigation and enforcement calculations); the communication device 12 (or data radio) (which may be used to facilitate the communications between the on-board computers 10 in one or more of the locomotives or control cars (L) of a train (TR), communications with a wayside device, e.g., signals, switch monitors, wayside devices, and the like, and/or communications with a remote server, e.g., a back office server 23, a central controller, central dispatch, and the like); a track database 14 and/or other database configured to store train related information (which may include information about track positions or locations, switch locations, crossing locations, track heading changes, e.g., curves, distance measurements, train information, e.g., the number of locomotives or control cars (L), the number of railcars (RC), the number of conventional passenger cars, the number of control cars, the total length of the train (TR), the specific identification numbers of each locomotive or control car (L) where PTC equipment (e.g., an on-board computer 10) is located, and the like); a braking system 16; a navigation system optionally including a positioning system 18 (e.g., a Global Positioning System (GPS)) and/or a wheel tachometer/speed sensor 20), such as in a PTC-equipped locomotive or control car (L); and a visual display device 24 (or operator interface), typically located in the locomotive or control car (L), which is in direct or indirect communication with the on-board computer 10 and provides information and data to the operator, such as the information, data, audio, and/or screens as discussed hereinafter. It should also be recognized that some or all of the steps and processing described herein may be performed locally by the on-board computer 10 of the locomotive or control car (L), or alternatively, by another computer (e.g., a computer associated with the end-of-train unit, a computer associated with a wayside device, and the like) and/or a remote computer or server (e.g., the back office server 23, a remote computer or server associated with central dispatch, a central controller, a computer-aided dispatch system, and intermediate control computer, and the like). In some examples, train information, e.g., the number of locomotives or control cars (L), the number of railcars (RC), the number of conventional passenger cars, the number of control cars, the total length of the train (TR), the specific identification numbers of each locomotive or control car (L) where PTC equipment (e.g., an on-board computer 10) is located, and the like) can be provided by the back office server 23 to the train (TR) for each trip.

Further, and as discussed, the on-board computer 10 includes or is in communication with the communication device 12 (e.g., a data radio, a communication interface, a communication component, and/or the like), which facilitates communication by or between locomotives or control cars (L) and/or the locomotive or control car (L) and some remote server or computer system, e.g., a central controller, a back office server 23, a remote server, central dispatch, back office PTC components, various wayside devices, such as signal or switch monitors, or other on-board computers 10 in the railway system. Further, this communication may occur wirelessly or in a "hard wired" form, e.g., over the rails of the track.

As discussed, the on-board computer 10 may be located at any position or orientation on the train (TR), and the on-board computer 10 (or on-board controller, on-board computer system, train management computer, and/or the like, and which performs the determinations and/or calculations for the Positive Train Control (PTC) system) includes or is in communication with the track database 14 populated with data and/or which receives specified data and information from other trains, remote servers, back office servers 23, central dispatch, and/or the like, where this data may include track profile data, train data, information about switch locations, track heading changes (e.g., curves, and distance measurements), train consist information (e.g., the number of locomotives, the number of cars, the total length of the train (TR)), and/or the like. Of course, it is envisioned that any type of train management system can be used within the context and scope of the present invention. For example, the train information, e.g., the number of locomotives or control cars (L), the number of railcars (RC), the number of conventional passenger cars, the number of control cars, the total length of the train (TR), the specific identification numbers of each locomotive or control car (L) where PTC equipment (e.g., an on-board computer 10) is located, and the like) can be provided by the back office server 23 to the train (TR) for each trip.

Figure 4:
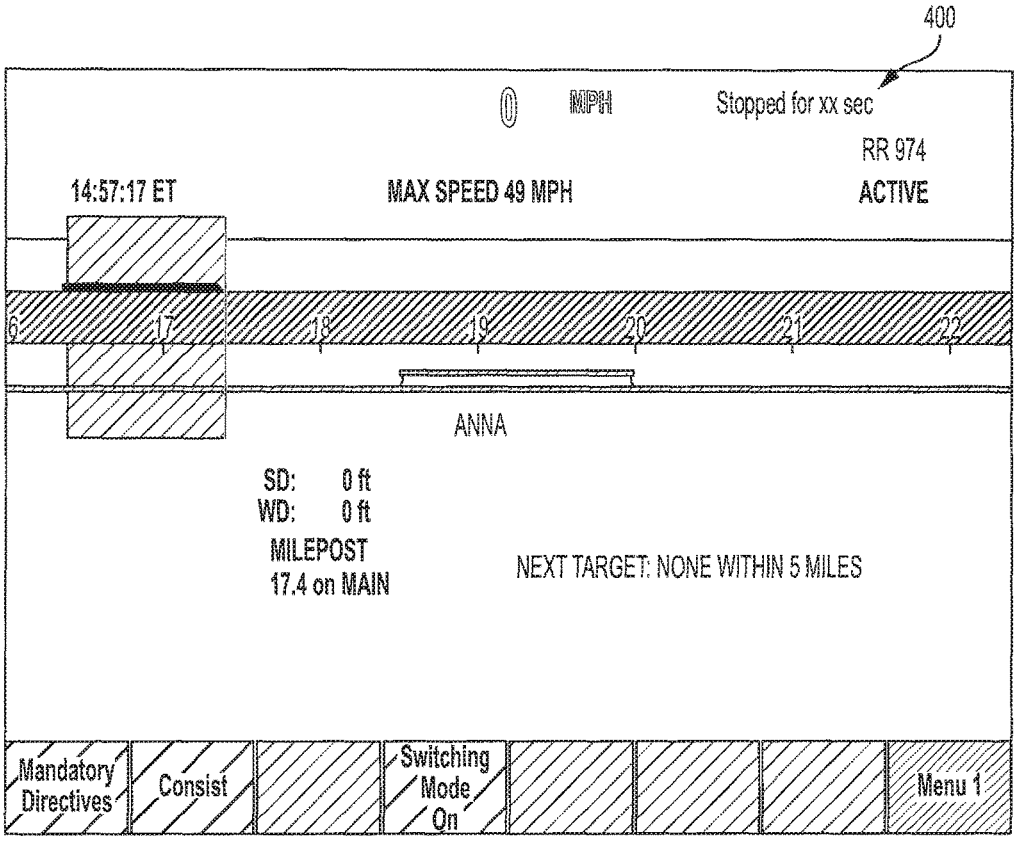
FIG. 4 illustrates an example operator interface of a train control system according to the principles of the present invention.

A train control system and method for determining and/or providing onboard a locomotive an amount of time that a train is stopped for a train (TR) including at least one locomotive or control car (L) and, optionally, at least one railroad car (RC), in a track network having a plurality of tracks includes an operator interface, which as discussed herein, can be located on-board the at least one locomotive or control car and configured to provide information to an operator of the train. For example, the operator interface may include a visual display device 24, which is typically located in the locomotive or control car (L). The visual display device 24 is in direct or indirect communication with the on-board computer 10 and provides information and data to the operator, such as the information, data, audio, and/or screens as discussed hereinafter. The visual display device 24 can be configured to display a current count or time of a counter or timer 400 to an operator or crew of the train. For example, the visual display device 24 can provide the operator interface of a train control system as shown in FIG. 4 with the current count or time of the counter or timer 400 displayed in the upper right hand corner of the visual display device 24.

The counter or timer may be implemented in software and/or hardware by at least one computer. For example, the counter or timer may be implemented as a local counter or timer on-board the at least one locomotive or control car (L) and, in some implementations, the on-board computer 10 can implement the counter or timer based on an internal clock of the on-board computer 10. In other implementations, the counter or timer may be implemented external to the train (TR), for example, as part of the back office server 23, and the on-board computer 10 can receive the current count or time of the counter or timer from the back office server 23 in a continuous or periodic manner, or in response to a request for the current count or time sent from the on-board computer 10 to the back office server 23 by communications device 12.

Figure 3:
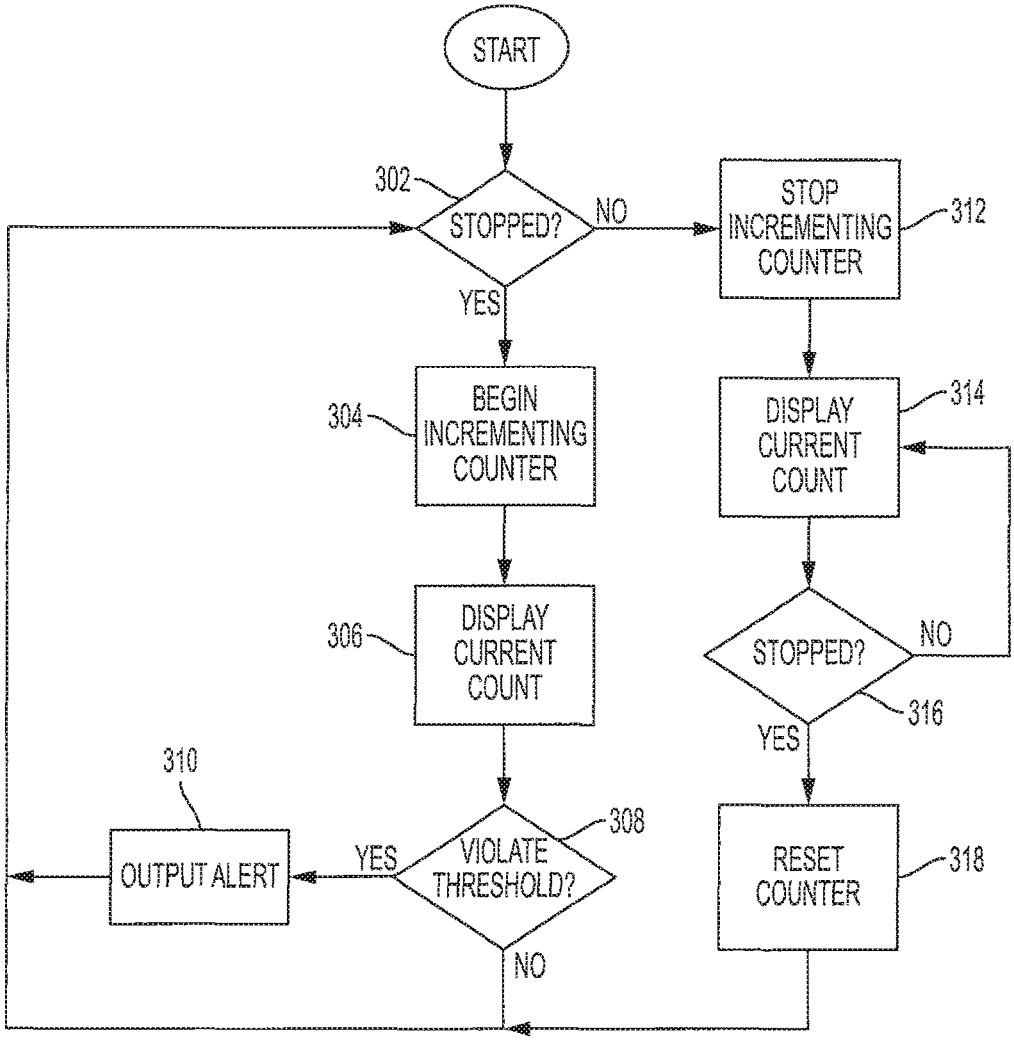
FIG. 3 is a flow chart of a method for determining and/or providing onboard a locomotive an amount of time that a train is stopped according to the principles of the present invention.

The train control system and method for determining and/or providing onboard a locomotive an amount of time that a train is stopped includes at least one computer, which as discussed herein can include one or more of the following: a specially-programmed computer, an on-board controller, an on-board computer 10 (as discussed hereinafter), a train management computer, a remote server, a back office server, a wayside device, a PTC component, a networked computer, or any combination thereof. Referring to FIG. 3, the at least one computer can determine whether the train (TR) is stopped in Scenario 302. For example, the at least one computer is programmed or configured to receive or determine an indication that the train is stopped. In an example, the onboard computer 10 of the at least one locomotive or control car (L) and/or a remote computer, such as, the back office server 23, can receive an output from a wheel tachometer, e.g., speed sensor 20, of the train (TR) that indicates a current speed of the train (TR) and/or the rotation speed of a wheel of the train (TR) and determine based on the output whether the train (TR) is currently stopped or currently moving. The wheel tachometer is preferably an active wheel tachometer that continues to produce output pulses at zero miles per hour, i.e., that continues to provide an output to the at least one computer even when the train is not moving that indicates that the train is not moving. An active wheel tachometer can reduce an ambiguity that may arise as to when the locomotive (L) or the train (TR) is actually stopped as compared to a passive wheel tachometer that may not reliably report a speed of the locomotive (L) or the train (TR) under five miles per hour.

In another implementation, the onboard computer 10 of the at least one locomotive or control car (L) and/or a remote computer, such as, the back office server 23, can receive an output of sensor data from one or more inertial sensors of the train (TR), e.g., motion sensors (accelerometers) and rotation sensors (gyroscopes), to continuously calculate via dead reckoning the position, orientation, and velocity (direction and speed of movement) of the train (TR). The onboard computer 10 can determine based on the output from the inertial sensors whether the train (TR) is currently stopped or currently moving.

In still another implementation, the onboard computer 10 of the at least one locomotive or control car (L) and/or a remote computer, such as, the back office server 23, can receive an output of GPS data from the GPS that indicates a current speed of the train (TR) and determine based on the output from the GPS whether the train (TR) is currently stopped or currently moving.

In one implementation, the positioning system 18 can determine at least one location of the train using the Russian global positioning system GLONASS. The onboard computer 10 of the at least one locomotive or control car (L) and/or a remote computer, such as, the back office server 23, can receive an output of GLONASS data from the GLONASS system that indicates a current speed of the train (TR) and determine based on the output from the GLONASS system whether the train (TR) is currently stopped or currently moving.

In a further implementation, the positioning system 18 can determine at least one location of the train using a Wi-Fi position system. The onboard computer 10 of the at least one locomotive or control car (L) and/or a remote computer, such as, the back office server 23, can receive an output of Wi-Fi positioning data from the Wi-Fi positioning system that indicates a current speed of the train (TR) and determine based on the output from the Wi-Fi positioning system whether the train (TR) is currently stopped or currently moving.

The onboard computer 10 may use output from one or more of the wheel tachometer, the inertial sensor, the GPS, GLONASS system, and the Wi-Fi positioning system to determine whether the train (TR) is currently stopped or currently moving. For example, the onboard computer 10 may require that the output from each of the wheel tachometer, the inertial sensor, the GPS, the GLONASS system, and/or the Wi-Fi positioning system indicate that the train (TR) is moving in order to determine that the train (TR) is currently moving (or vice versa that the train is currently stopped). In another implementation, the onboard computer 10 may rank the outputs such that a higher ranked output overrides an indication from a lower ranked output. For example, if the GPS data indicates that the train is currently moving, but the output from the wheel tachometer indicates that the train is currently stopped, the onboard computer 10 may rely on the indication from the wheel tachometer over that of the GPS data.

If the at least one computer determines in Scenario 302 that the train (TR) is stopped, the at least one computer can begin to continuously increment the counter or timer in Scenario 304. For example, the at least one computer can begin to increment the counter or timer by counting upwards or downwards from zero or another predetermined amount, such as a threshold amount, in one second increments (or any other unit or increment of time) in response to a deter urination by the at least one computer that the train (TR) is stopped. The at least one computer continues to increment the counter or time while the train (TR) remains stopped, i.e., until the at least one computer determines that the train (TR) is moving again.

Figure 5:
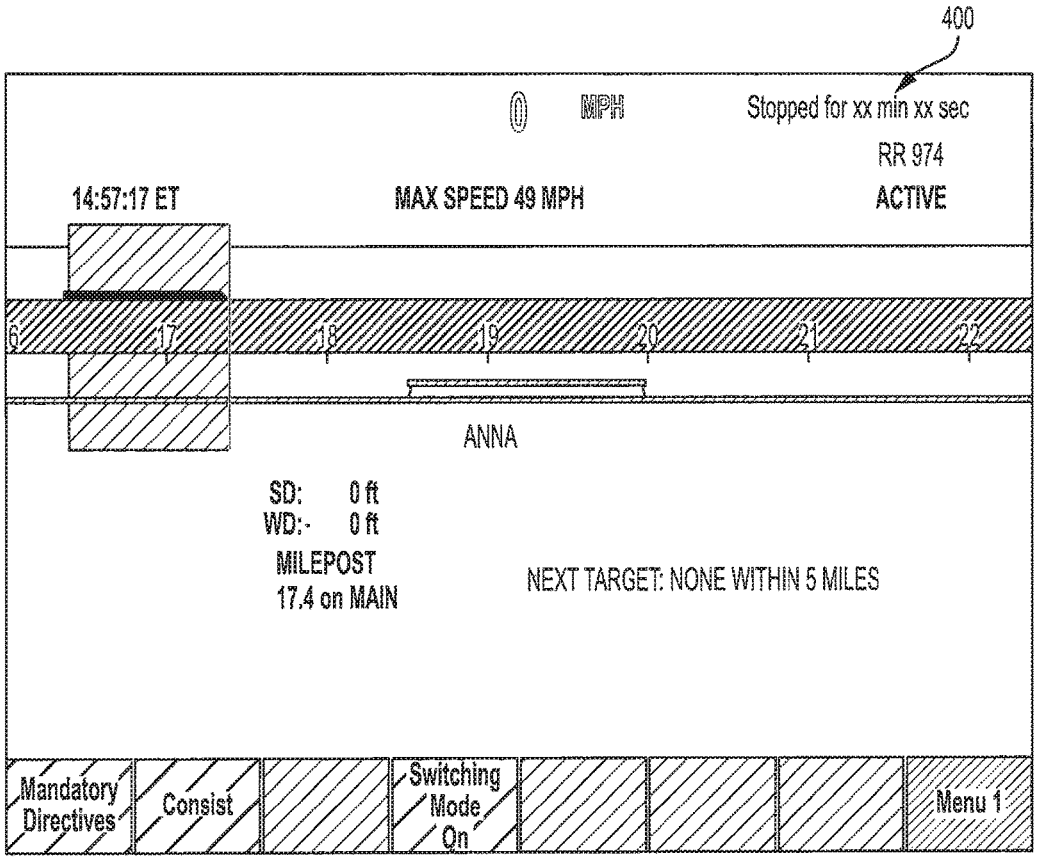
FIG. 5 illustrates an example operator interface of a train control system according to the principles of the present invention.

In Scenario 306, the at least one computer can control the operator interface to output the current count or time of the counter or timer 400 to the operator of the train. For example, the operator interface may comprise the visual display device 24 configured to display the current count or time of the counter or timer 400 to the operator of the train. As shown in FIG. 4, the current count or time of the counter or the timer 400 may be displayed in the upper right hand corner of the visual display device 24. The current count or time may be displayed in increments of seconds and, when the period the locomotive has been stopped exceeds 59 seconds, the current count or time of the counter or the timer 400 may be updated to show the time in minutes and seconds as shown in FIG. 5. However, example embodiments are not limited thereto and the current count or time may be represented by an icon and/or color representing how long the train has been stopped and/or if the train has been stopped for a period of time that exceeds a threshold period as discussed further herein. For example, a green train icon may represent that the train has been stopped at a station stop for an acceptable period of time, whereas a red train icon may represent a train that has been stopped at the station stop for an unacceptable period of time, e.g., a period of time that exceeds a threshold period for stops at the station.

In another example, the operator interface may comprise an audio output device configured to output an audible signal based at least partly on the current count or time of the counter or timer. For example, an audio output indicating the current count or time of the count or timer may be played in a continuous or periodic manner, in response to the train being stopped for a period of time that exceeds a threshold period, and/or in response to a request for the current count or time from the operator or crew of the train. The audio output device can be implemented as part of the visual display device 24, such as speakers incorporated therein.

Figure 6:
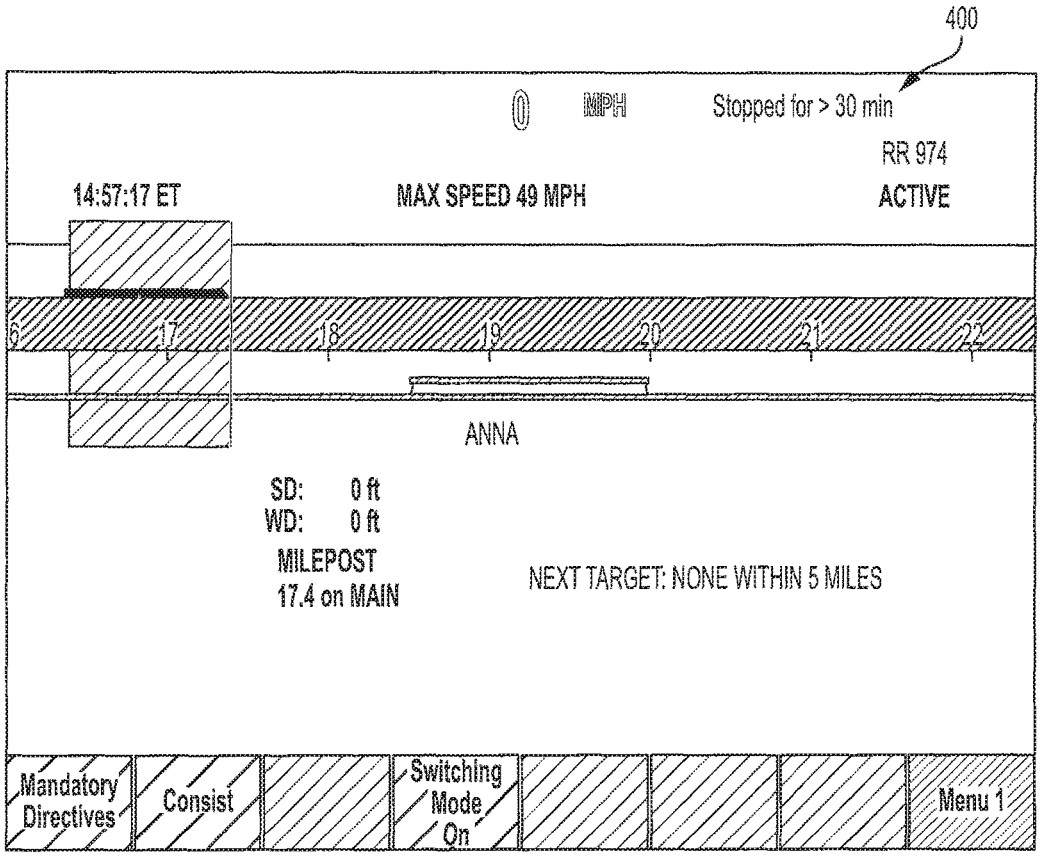
FIG. 6 illustrates an example operator interface of a train control system according to the principles of the present invention.

In an example, in Scenario 308 the at least one computer is programmed or configured to compare the current count or time of the counter or timer 400 to a threshold count or time period and control the operator interface to output an alert in Scenario 310 if the current count or time of the counter or timer violates the threshold count or time period. The threshold count may be a user configurable period of time that can be set by the operator or crew of the train or by dispatching authorities, for example, in a configuration file for the train control system. When the current count or time is determined by the at least one computer to violate the user configurable period or threshold count, the operator interface may be updated to indicate that the period of time that the train (TR) has been stopped exceeds the user configurable period. The counter or timer may be stopped or continue to increment after the threshold count or user configurable time period is violated. As shown in the example operator interface of FIG. 6, when the threshold period is set to 30 minutes and the current count or time exceeds the 30 minute period, the at least one computer controls the visual display device 24 to display an indication that the amount of time that the train (TR) has been stopped exceeds the threshold period.

In another example, the at least one computer can be programmed or configured to receive or determine at least one location associated with the train, the at least one locomotive or control car of the train, the at least one railroad car, or any combination thereof. For example, the positioning system 18 can determine the at least one location of the train using GPS, inertial sensors, e.g., motion sensors (accelerometers) and rotation sensors (gyroscopes), that continuously calculate via dead reckoning the position, orientation, and velocity (direction and speed of movement) of the train (TR), or another location determination technique. The at least one computer may compare the location information from the GPS or inertial sensors to track data to determine the location of the train (TR) in the track network and the location of track features currently within a threshold distance of the train (TR) in the track network. The at least one computer can compare the current count or time of the counter to a threshold count associated with the at least one location. For example, the track database 14 can store track feature data associated with locations in the track network, and a particular track feature, such as a crossing or a passenger station, can be associated with a specific threshold count or period of time. A user can set a threshold period for a particular track feature, e.g., a PTC track data feature such as a grade crossing or a station sign, in the track database 14, and the at least one computer can control the operator interface to output an alert if the current count or time of the counter or timer 400 violates the threshold count or time period associated with the at least one location. For example, when the location of the train (TR) is determined to overlap the location of a track feature, e.g., be within a threshold distance of the track feature, and the train (TR) is determined to have been stopped for a period of time equal to or greater than the threshold period associated with the track feature, the at least one computer can change the color of the display of the counter or timer 400 in the visual display device 24 and/or control an audio output device to output an audible alert to draw the attention of the operator or crew.

In one implementation, an on-board computer 10, a train management computer, a remote server, a back office server 23, a wayside device, a PTC component, a networked computer, or any combination thereof can store threshold counts in association with particular track features in the track data, e.g., passenger stations. Different threshold counts can be associated with different track features. In another implementation, an on-board computer 10, a train management computer, a remote server, a back office server 23, a wayside device, a PTC component, a networked computer, or any combination thereof can store a configurable parameter in a file separate from the track data that defines the threshold count(s) for track features of a given type, e.g., grade crossings. For example, the threshold count(s) for grade crossing may be stored in a first file and the threshold count(s) for passenger stations may be stored in a second, separate file, which allows for more flexibility in setting the threshold counts for different types of track features.

In still another implementation, a remote server, a back office server 23, a wayside device, a PTC component, a networked computer, or any combination thereof can send a real-time message with the threshold count(s) for a list of track features (for example, the station stop times for a given day for a given route) to the on-board computer 10 of the train (TR). These threshold counts may override "default" threshold counts in the track data or in a configuration file. For example, the on-board computer 10 may replace a threshold count stored in the track data indicating that the threshold count for a particular station stop is 5 minutes with an updated threshold count received from a remote server, a back office server 23, a wayside device, a PTC component, a networked computer, or any combination thereof indicating that the threshold count for the particular station stop is now shorter or longer than 5 minutes, for example, to adjust the schedule of the train. Threshold counts stored by or transmitted from an on-board computer 10, a train management computer, a remote server, a back office server 23, a wayside device, a PTC component, a networked computer, or any combination thereof can be configured to be automatically updated in the train control system based on various factors including a time of day, current rail traffic at or nearby the associated track feature (e.g., a busy or empty station stop), a current operator of the train (TR), whether the train (TR) is running on schedule or behind schedule, a type of the train (TR) (e.g., commuter or freight), and any other information determined and/or stored by the train control system.

Figure 7:
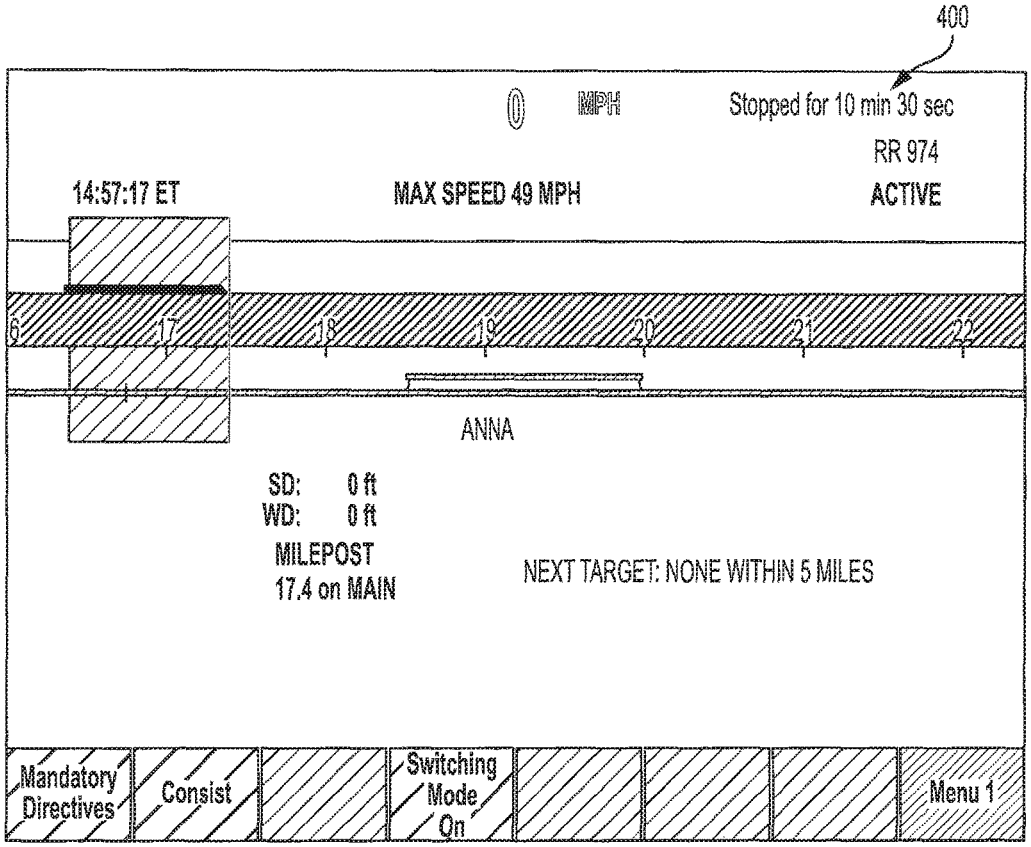
FIG. 7 illustrates an example operator interface of a train control system according to the principles of the present invention.

FIG. 7 shows an example of the visual display device 24 indicating a stropped train blocking a grade crossing (indicated by the vertical line) for more than a threshold period of ten minutes associated with the grade crossing. The at least one computer can thus use the track feature data to determine when the train (TR) is stopped within a threshold distance of a track feature of interest and draw attention to the counter or timer when the threshold count or configurable period of time associated with the track feature is violated.

If the at least one computer determines in Scenario 302 that the train (TR) is moving, i.e., not stopped, the at least one computer stops the incrementing of the counter in Scenario 312. The at least one computer can be programmed or configured to receive or determine an indication that the train is moving. For example, the onboard computer 10 of the at least one locomotive or control car (L) and/or a remote computer, such as, the back office server 23, can receive an output from a wheel tachometer, e.g., speed sensor 20, of the train (TR) that indicates a current speed of the train (TR) and/or the rotation speed of a wheel of the train (TR) and determine based on the output whether the train (TR) is currently stopped or currently moving, and the at least one computer is programmed or configured to stop incrementing the counter in response to the indication that the train is moving.

Figure 8:
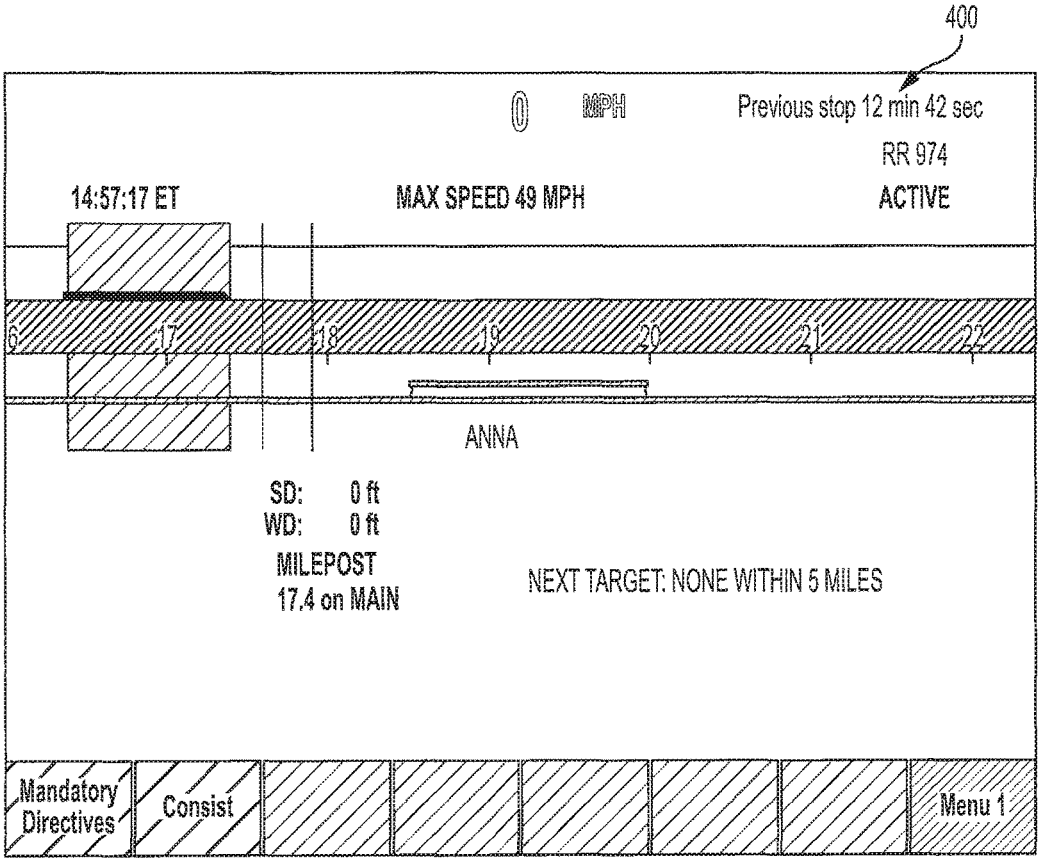
FIG. 8 illustrates an example operator interface of a train control system according to the principles of the present invention.

The at least one computer can control the operator interface to continue to output the current count or time of the counter or timer 400 in Scenario 314, i.e., to continuously output a count at which the counter stopped incrementing when the train is moving, so that the operator or crew can record the period for which the train (TR) was stopped at their convenience after the train (TR) has resumed movement, e.g., after the train leaves a station or other stop. For example, as shown in FIG. 8, the at least one computer can stop the incrementing of the counter and control the visual display device 24 to show the period for which the locomotive had been previously stopped in greyed out text to allow the operator or crew to record the duration of the stop at their convenience after the locomotive has left the stop.

In an example, the at least one computer can store the count or time at which the counter or timer stopped incrementing in local memory and/or in an on-board database, such as the track database 14, or in remote servers, back office servers 23, central dispatch, and/or the like. In another example, the at least one computer can transmit the count or time at which the counter or timer stopped incrementing via the communications device 12 to an external location, such as the back office server 23. The count at which the counter or timer stopped incrementing can be stored in association with a timestamp of the stop, e.g., a local time of the stop, an identifier of the train (TR) and/or the locomotives (L) and/or railcars (RC) in the train (TR), a location of the train (TR) during the stop, and/or a track feature associated with the location of the train (TR) during the stop.

The at least one computer can transmit the count or time at which the counter or timer stopped incrementing via the communications device 12 to an external location, such as the back office server 23, when the counter or timer stops incrementing, when the count violates a threshold count, periodically, and/or each time the count is incremented.

After the train (TR) resumes movement, the at least one computer can determine whether the train (TR) is stopped in Scenario 316. Until the train (TR) stops, the at least one computer can continue to control the operator interface to output the count or time at which the counter previously stopped incrementing by returning to Scenario 314. If, in Scenario 316, the at least one computer determines that the train (TR) is stopped, e.g., by receiving or determining an indication that the train (TR) is stopped, the at least one computer can reset the current count or time of the counter or timer 400 in response to the indication that the train is stopped in Scenario 318 before returning to Scenarios 302 and 304 to begin continuously incrementing the counter in response to the indication that the train is stopped.

In this manner, provided is an improved system and method for determining and/or providing onboard a locomotive an amount of time that a train is stopped.

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A train control system for a train including at least one locomotive or control car and, optionally, at least one railroad car, in a track network having a plurality of tracks, the system comprising:

an operator interface on-board the at least one locomotive or control car configured to provide information to an operator of the train;

a wheel tachometer configured to provide an indication that the train is stopped; and at least one computer programmed or configured to:

receive the indication that the train is stopped from the wheel tachometer;

continuously increment a counter in response to receiving the indication that the train is stopped; and control the operator interface to output a current count of the counter to the operator of the train.

2. The train control system of claim 1, wherein the wheel tachometer is configured to provide an indication that the train is moving, and wherein the at least one computer is programmed or configured to:

receive the indication that the train is moving; and stop incrementing the counter in response to receiving the indication that the train is moving.

3. The train control system of claim 1, wherein the operator interface comprises a visual display device configured to display the current count of the counter to the operator of the train.

4. The train control system of claim 1, wherein the operator interface comprises an audio output device configured to output an audible signal based at least partly on the current count of the counter.

5. The train control system of claim 1, wherein the at least one computer is programmed or configured to:

compare the current count of the counter to a threshold count; and control the operator interface to output an alert if the current count of the counter violates the threshold count.

6. The train control system of claim 1, wherein the at least one computer is programmed or configured to:

receive or determine at least one location associated with the train, the at least one locomotive or control car of the train, the at least one railroad car, or any combination thereof;

compare the current count of the counter to a threshold count associated with the at least one location; and control the operator interface to output an alert if the current count of the counter violates the threshold count associated with the at least one location.

7. The train control system of claim 6, wherein the at least one computer is programmed or configured to:

determine that the at least one location corresponds to a location of a track data feature, wherein the location of the track data feature is associated with the threshold count.

8. The train control system of claim 6, further comprising at least one of a GPS and an inertial sensor system, wherein the at least one computer is programmed or configured to:

determine the at least one location associated with the train, the at least one locomotive or control car of the train, the at least one railroad car, or any combination thereof based on data received from at least one of the GPS, the inertial sensor system, or any combination thereof.

9. The train control system of claim 1, wherein the at least one computer is programmed or configured to:

control the operator interface to continuously output a count at which the counter is stopped incrementing when the train is moving.

10. The train control system of claim 1, wherein the at least one computer is programmed or configured to:

reset the current count of the counter in response to the indication that the train is stopped before continuously incrementing the counter.

11. The train control system of claim 1, further comprising at least one of a GPS, an inertial sensor system, a GLONASS system, a Wi-Fi positioning system, or any combination thereof, wherein the at least one computer is programmed or configured to:

determine the indication that the train is stopped based on output data from at least one of the GPS, the inertial sensor system, the GLONASS system, the Wi-Fi positioning system or any combination thereof.

12. A computer implemented train control method for a train including at least one locomotive or control car and, optionally, at least one railroad car, in a track network having a plurality of tracks, the method comprising:

determining, with a wheel tachometer, an indication that the train is stopped;

continuously incrementing, with at least one processor, a counter in response to receiving the indication that the train is stopped from the wheel tachometer; and controlling, with at least one processor, an operator interface on-board the at least one locomotive or control car to output a current count of the counter to the operator of the train.

13. The train control method of claim 12, further comprising:

determining, with a wheel tachometer, an indication that the train is moving;

receiving, with at least one processor, the indication that the train is moving; and stopping, with at least one processor, incrementing of the counter in response to the indication that the train is moving.

14. The train control method of claim 12, wherein the operator interface comprises a visual display device, the method further comprising:

controlling, with at least one processor, the visual display device to display the current count of the counter to the operator of the train.

15. The train control method of claim 12, wherein the operator interface comprises an audio output device, the method further comprising:

controlling, with at least one processor, the audio output device to output an audible signal based at least partly on the current count of the counter.

16. The train control method of claim 12, further comprising:

comparing, with at least one processor, the current count of the counter to a threshold count; and controlling, with at least one processor, the operator interface to output an alert if the current count of the counter violates the threshold count.

17. The train control method of claim 12, further comprising:

receiving or determining, with at least one processor, at least one location associated with the train, the at least one locomotive or control car of the train, the at least one railroad car, or any combination thereof;

comparing, with at least one processor, the current count of the counter to a threshold count associated with the at least one location; and controlling, with at least one processor, the operator interface to output an alert if the current count of the counter violates the threshold count associated with the at least one location.

18. The train control method of claim 17, further comprising:

determining, with at least one processor, that the at least one location corresponds to a location of a track data feature, wherein the location of the track data feature is associated with the threshold count.

19. The train control method of claim 17, further comprising:

determining, with at least one processor, the at least one location associated with the train, the at least one locomotive or control car of the train, the at least one railroad car, or any combination thereof based on output data received from at least one of a GPS, an inertial sensor system, or any combination thereof.

20. The train control method of claim 12, further comprising:

controlling, with at least one processor, the operator interface to continuously output a count at which the counter is stopped incrementing when the train is moving.

21. The train control method of claim 12, further comprising:

resetting, with at least one processor, the current count of the counter in response to the indication that the train is stopped before continuously incrementing the counter.

22. The train control method of claim 12, further comprising:

determining, with at least one processor, the indication that the train is stopped based on output data from at least one of a GPS, an inertial sensor system, a GLONASS system, a Wi-Fi positioning system, or any combination thereof.

23. A train control system for a train including at least one locomotive or control car and, optionally, at least one railroad car, in a track network having a plurality of tracks, the system comprising:

an operator interface on-board the at least one locomotive or control car configured to provide information to an operator of the train; and at least one computer programmed or configured to:

receive or determine an indication that the train is stopped;

continuously increment a counter in response to the indication that the train is stopped;

control the operator interface to output a current count of the counter on-board the at least one locomotive or control car to the operator of the train, wherein the operator interface comprises at least one of (i) a visual display device configured to display the current count of the counter on-board the at least one locomotive or control car to the operator of the train and (ii) an audio output device configured to output, on-board the at least one locomotive or control car to the operator of the train, an audible signal based on the current count of the counter;

receive or determine at least one location associated with the train, the at least one locomotive or control car of the train, the at least one railroad car, or any combination thereof;

compare the current count of the counter to a threshold count associated with the at least one location; and control the operator interface to output an alert if the current count of the counter violates the threshold count associated with the at least one location.

24. The train control system of claim 23, further comprising an active wheel tachometer configured to provide the indication that the train is stopped to the at least one computer.

25. The train control system of claim 23, further comprising at least one of a GPS, an inertial sensor system, a GLONASS system, a Wi-Fi positioning system, or any combination thereof, wherein the at least one computer is programmed or configured to:

determine the indication that the train is stopped based on output data from at least one of the GPS, the inertial sensor system, the GLONASS system, the Wi-Fi positioning system or any combination thereof.

26. A computer implemented train control method for a train including at least one locomotive or control car and, optionally, at least one railroad car, in a track network having a plurality of tracks, the method comprising:

receiving or determining, with at least one processor, an indication that the train is stopped;

continuously incrementing a counter in response to the indication that the train is stopped;

controlling, with at least one processor, an operator interface on-board the at least one locomotive or control car to output a current count of the counter on-board the at least one locomotive or control car to the operator of the train, wherein the operator interface comprises at least one of (i) a visual display device configured to display the current count of the counter on-board the at least one locomotive or control car to the operator of the train and (ii) an audio output device configured to output, on-board the at least one locomotive or control car to the operator of the train, an audible signal based on the current count of the counter;

receiving or determining, with at least one processor, at least one location associated with the train, the at least one locomotive or control car of the train, the at least one railroad car, or any combination thereof;

comparing, with at least one processor, the current count of the counter to a threshold count associated with the at least one location; and controlling, with at least one processor, the operator interface to output an alert if the current count of the counter violates the threshold count associated with the at least one location.

* * * * *